United States Patent [19]

Wallach

[11] Patent Number: 4,474,128

[45] Date of Patent: Oct. 2, 1984

[54] MULTI-HULLED SAILING VESSEL

[76] Inventor: Bruce A. Wallach, 5 Murdoch Crescent, Connells Points, New South Wales, Australia

[21] Appl. No.: 439,622

[22] Filed: Nov. 5, 1982

[30] Foreign Application Priority Data

Nov. 9, 1981 [AU] Australia ..... PF1485

[51] Int. Cl.[3] ..... B63B 43/14

[52] U.S. Cl. ..... 114/123; 114/61

[58] Field of Search ..... 114/61, 121, 122, 123, 114/126

[56] References Cited

U.S. PATENT DOCUMENTS

| | | | |
|---|---|---|---|
| 3,002,484 | 10/1961 | Dube | 114/61 |
| 3,232,261 | 2/1966 | Graig | 114/123 |
| 3,702,106 | 11/1972 | Wilder | 114/123 |
| 3,807,333 | 4/1974 | Ross | 114/123 |
| 3,881,440 | 5/1975 | Mason | 114/123 |
| 3,929,085 | 12/1975 | Mason | 114/123 |
| 3,954,077 | 5/1976 | Plat-Marchand | 114/123 |

FOREIGN PATENT DOCUMENTS

| | | | |
|---|---|---|---|
| 2552021 | 5/1977 | Fed. Rep. of Germany | 114/123 |
| 553899 | 6/1923 | France | 114/123 |
| 2460250 | 2/1981 | France | 114/61 |

*Primary Examiner*—Trygve M. Blix
*Assistant Examiner*—Jesûs D. Sotelo
*Attorney, Agent, or Firm*—Murray, Whisenhunt and Ferguson

[57] ABSTRACT

A sailing vessel having the performance capabilities of a multi-hull craft with the superior stability of a ballasted mono-hull craft, comprising a central hull supporting a mast and a pair of lateral hulls substantially parallel to the central hull and connected thereto by arms which are pivotably connected to the central hull such that each arm can pivot about an axis substantially parallel to the longitudinal axes of the hull. Springs act between the central hull and each of the arms such that pivotal movement of each arm is only possible against the bias of the spring. Excessive wind loading is thereby shed from the sail by the mast and the central hull pivoting relative to the lateral hulls.

10 Claims, 22 Drawing Figures

MULTI-HULLED SAILING VESSEL

Figure 2:
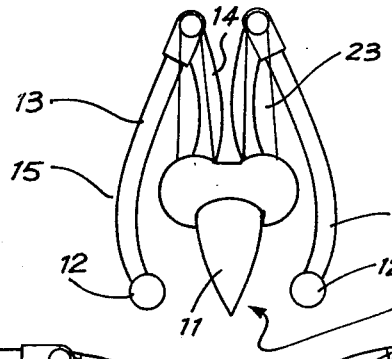

The present invention relates to a multi-hull sailing vessel and more particularly to a multi-hull sailing vessel such as a catamaran or a trimaran in which capsize due to excessive heeling of the vessel under applied wind loads on the sail can be avoided.

Multi-hull sailing boats with the hulls interconnected by rigid or semi-rigid means are capable of carrying large sail area relative to their displacement due to their high initial stability resulting from the separation of their hulls and can achieve relatively high sailing speeds under favourable conditions. As the angle of heel of a multi-hull sailing boat increases the righting moment decreases until a critical angle of heel is attained. The critical angle of heel is where the righting moment falls to zero; in the case of a multi-hull craft this will be 90° or less. If such a boat capsizes it achieves a state of stable equilibrium in the inverted position. Small boats can be righted by the action of the crew with some difficulty but in larger seagoing, boats this would be impossible without external assistance. By contrast a ballasted single hulled sailing boat has smaller sail area relative to its displacement because of its lower initial stability. As it heels however, its righting moment increases and attains a maximum value when the angle of heel is about 90°. In the event of capsize a well designed boat of this type is self-righting. The smaller sail area and the self-righting characteristics of mono-hull craft both increase the safety of operation of such boats.

West German patent specification No. 2,435,005 discloses a trimaran in which the lateral hulls are connected to the cental hull by arms which include a pivotable connection along their length. In this construction as the mast heels under an applied wind force the leeward arm or arms will pivot however the windward arms remain rigid and raise the windward lateral hull off the water. This raised windward hull will then itself be subjected to wind pressure and will act to prevent the righting of the central hull and its attached mast.

The aim of this invention is to combine the performance capabilities of multi-hull sailing boats with the superior stability characteristics of ballasted single hulled sailing boats while avoiding, to at least a substantial degree, the disadvantages of the prior art described above.

The present invention consists in a sailing vessel comprising a pair of substantially parallel hulls each of which is connected to an intermediate mast supporting structure by arm means which are pivotably connected to the mast supporting structure such that each arm means can pivot about an axis substantially parallel to the longitudinal axes of the hulls; and spring means acting between the mast or the mast supporting structure and each of the arm means such that pivotal movement of either of the arm means is only possible against the bias of the spring, each of the arms of one set being linked to a corresponding arm of the other set such that pivotal movement of the one arm of the one set will cause a corresponding, but oppositely directed, pivotal movement of the corresponding arm of the other set.

While the present invention will normally be applied to a catamaran or a trimaran in principal the invention could be applied to any multi-hulled vessel.

The mast supporting structure may comprise a hull itself in which case the vessel will be a trimaran or alternatively the mast supporting structure may be reduced to form a structural element only which does not contact the water under normal circumstances in which case the vessel will be a catamaran.

The sails on the vessel will be rigged such that under certain sailing conditions, as when the vessel is close hauled or reaching, the wind in the sails will apply a heeling moment to the mast supporting structure. This moment is transmitted by the arm means to the leeward hull as a downward thrust into the water. The amount of thrust so transmitted in the vessel according to this invention is limited by the action of the spring means which will resist rotation of the leeward arm means and thus the leeward hull up to a pre-set limit, but will permit such rotation once this limit is exceeded. The adjustment of the spring means is pre-set to a limit such that the downward thrust transmitted to the leeward hull will not exceed the net buoyancy of that hull. In addition, the sail area must be so related to the weight of the vessel and its crew and to the buoyancy of the leeward hull that the whole vessel cannot be pivoted about the leeward hull under the lateral force of the wind.

It will be seen that in the present arrangement as the heeling moment due to the lateral force generated by the wind on the sails exceeds the pre-set limit of the spring means, the spring means will yield allowing the mast supporting structure and the mast to heel so reducing the heeling moment until equilibrium is re-established.

The arm means preferably comprise at least two opposed sets of arms. As has been described above the arms comprising each set are preferably linked together so that rotation of either arm will cause or permit a corresponding rotation of the other arm. If desired adjustment may be provided within the linkage to enable the ratio of rotation of one arm with respect to the other to be varied. If the linkage is set at a ratio of 1:1 i.e. if a rotation of the leeward arm means through $x^o$ will produce a corresponding and opposite rotation of $x^o$ in the windward arm means, then under still water conditions the windward arm means will maintain their initial inclination to the horizontal irrespective of the angle of heel of the mast supporting structure. This is advantageous as it keeps the heeling moment due to windage on the windward hull to a minimum. In other situations it might be desirable to adjust the ratio of the linkage to allow the windward arm means to rise relative to the horizontal as the mast supporting structure heels to permit the windward hull to be lifted out of the water at least sufficiently to clear minor waves. The adjustment of the linkage ratio is also desirable to increase or reduce the effect of crew on the windward side of the vessel. This weight is likely to be significant when the crew weight is comparable to, or even greater than, the buoyancy of the leeward hull.

The spring means preferably comprises a helical tension spring or a plurality of such springs although any other suitable spring means such as a torsion spring, compression spring, leaf spring, or torsion bar could also be used. In one preferred embodiment an array of such springs are connected at each end to cables which each pass around suitable pulleys and terminate on the outer periphery of a drum or sheave affixed to, and coaxial with the pivotal axis of, a corresponding arm of the arm means.

If desired the springs may be disposed longitudinally within a central hull to which the mast is affixed. In another embodiment of the invention the springs may extend transversely of the central hull where the hull has sufficient beam to allow this. In a still further embodiment, which is applicable to narrow hulled vessels, the springs may be disposed in the stays of the vessel.

In preferred embodiment of the present invention the arms constituting the arm means are each formed in two parts pivotably connected together at or adjacent the mid-point of the arm. This allows each arm to be capable of retracting to bring the hulls into close proximity to the mast supporting structure, and conversely, to be capable of being extended so that the outer hulls are separated from the mast supporting structure to provide the necessary lateral stability needed under sailing conditions.

The joint between the arm parts is preferably so constructed that the outer part of the arm can rotate with respect to the inner part about an axis parallel to the longitudinal axes of the hulls. The two arm parts are preferably so interlinked that rotation of the inner part with respect to the mast supporting structure, when it is disconnected from the spring means, causes a corresponding rotation of the outer arm part. Latch means are preferably provided to releasably latch the two arm parts together once they have been moved into their correct extended orientation.

The arrangement described in the immediately foregoing paragraphs allows the hulls to be retracted to facilitate land transport and storage, to reduce the overall beam of the vessel for navigating narrow waterways or for mooring, berthing or docking purposes. The mechanism can also be arranged such that the hulls will retract automatically upon the vessel capsising which can render a trimaran version of the present invention self righting.

Figure 1:
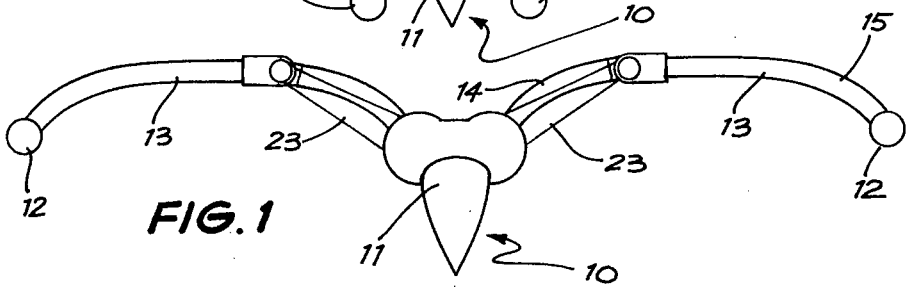
Figure 3:
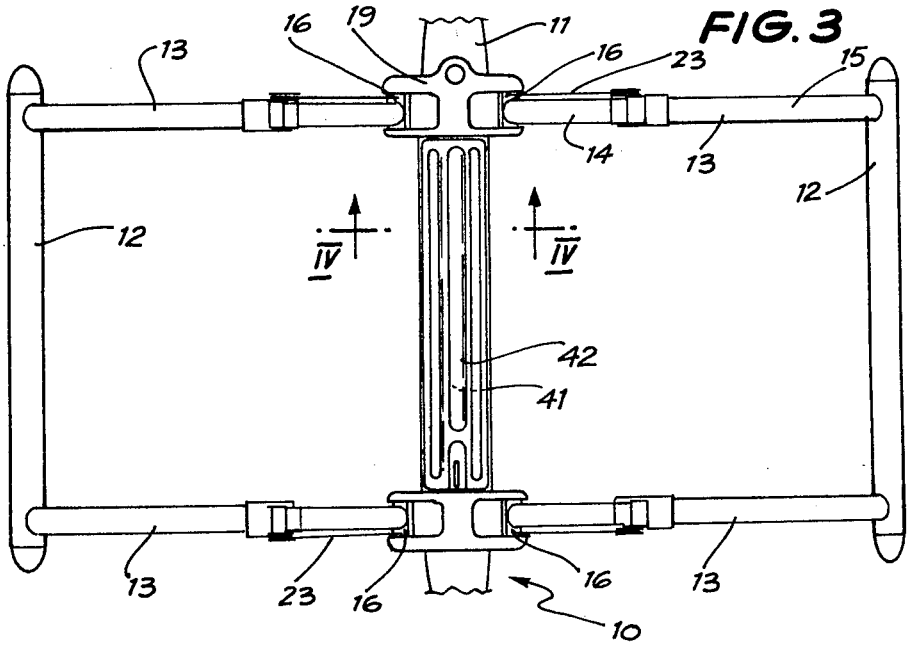
Figure 4:
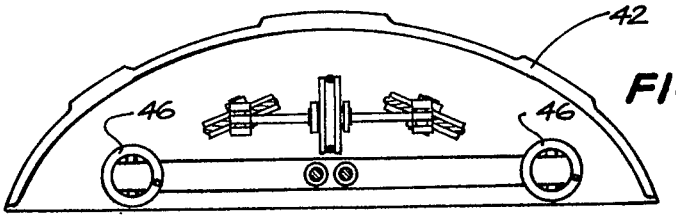
Figures 5, 6:
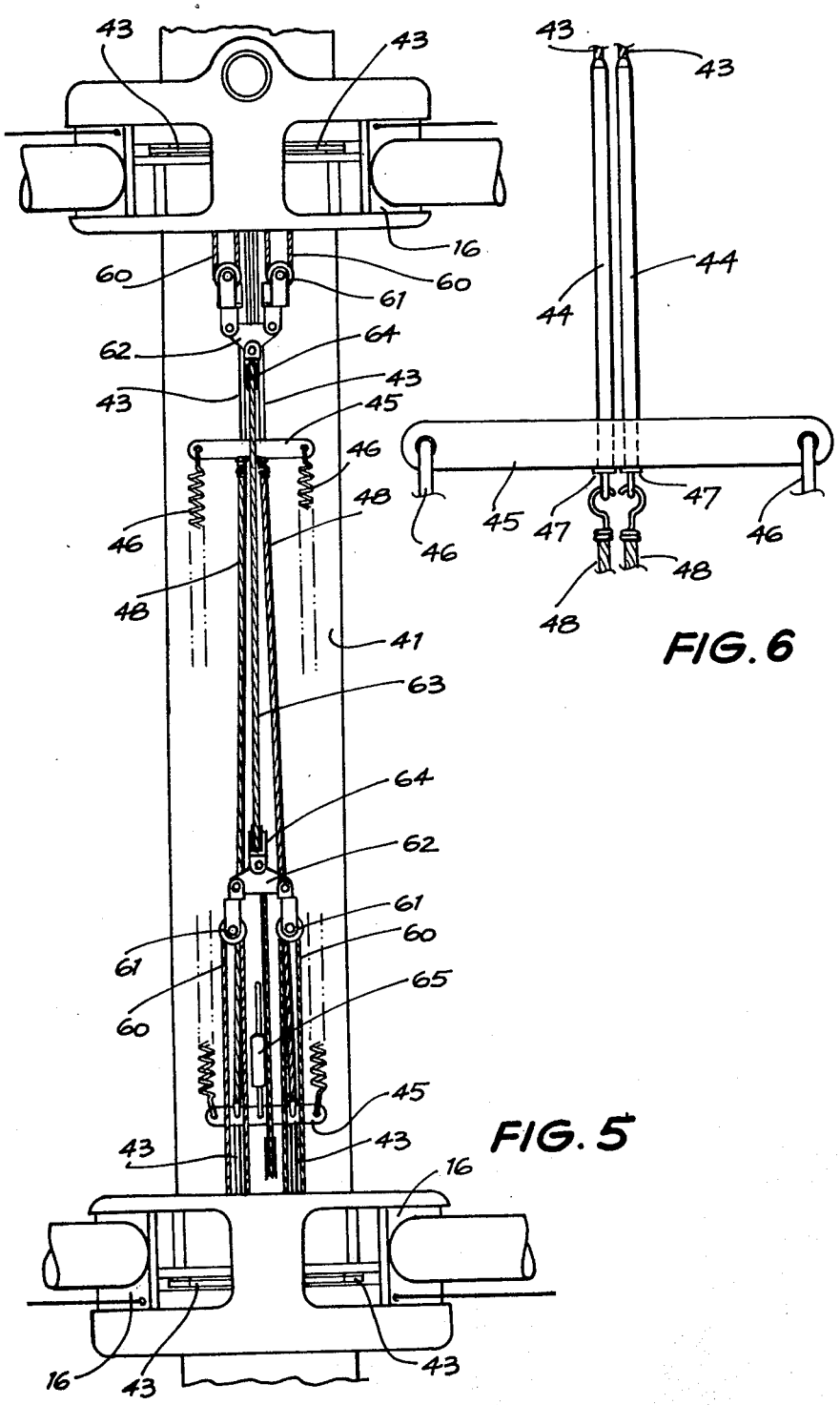
Figure 8:
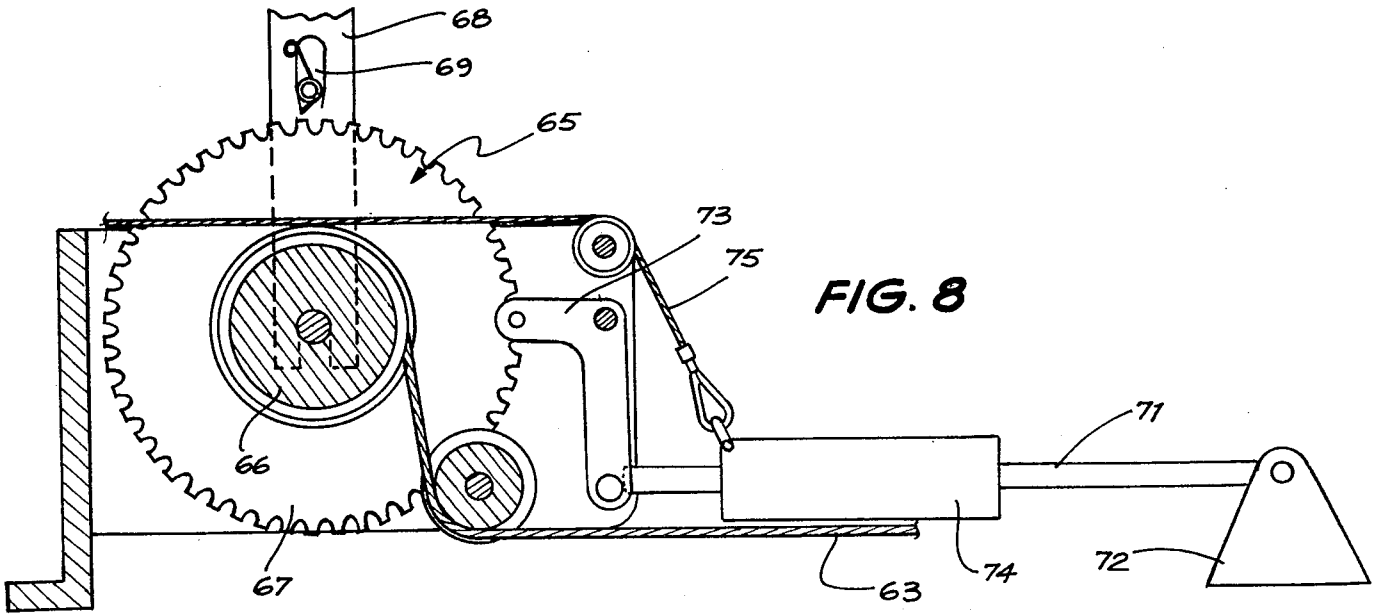
Figure 7:
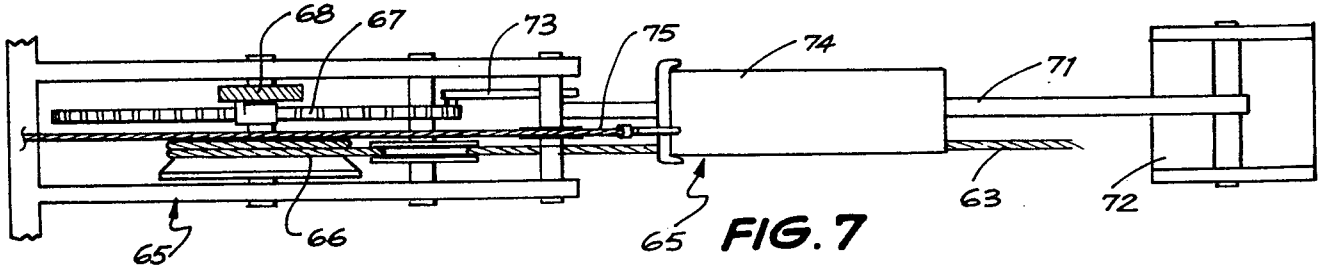
Figure 9:
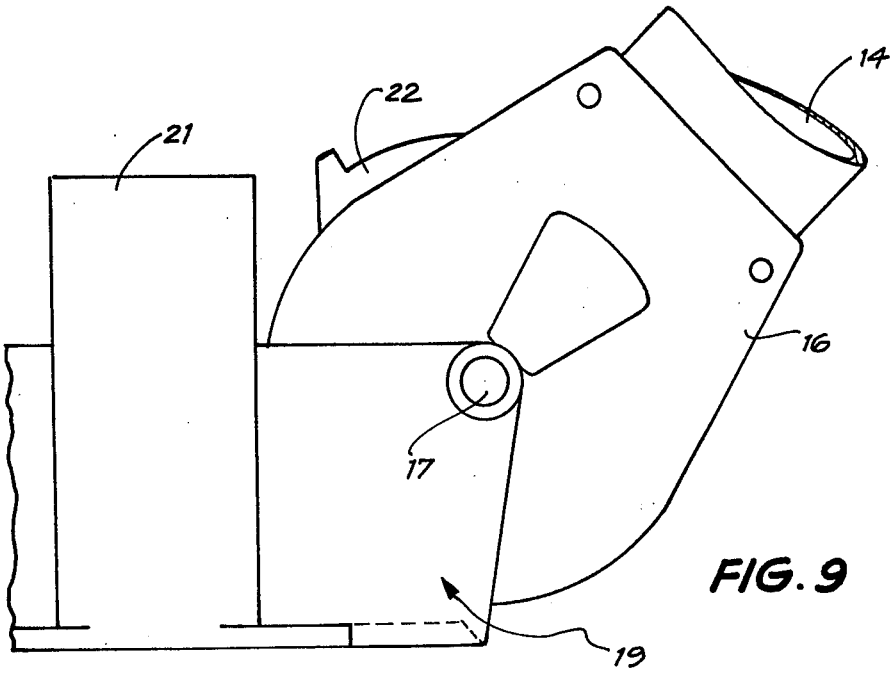
Figure 10:
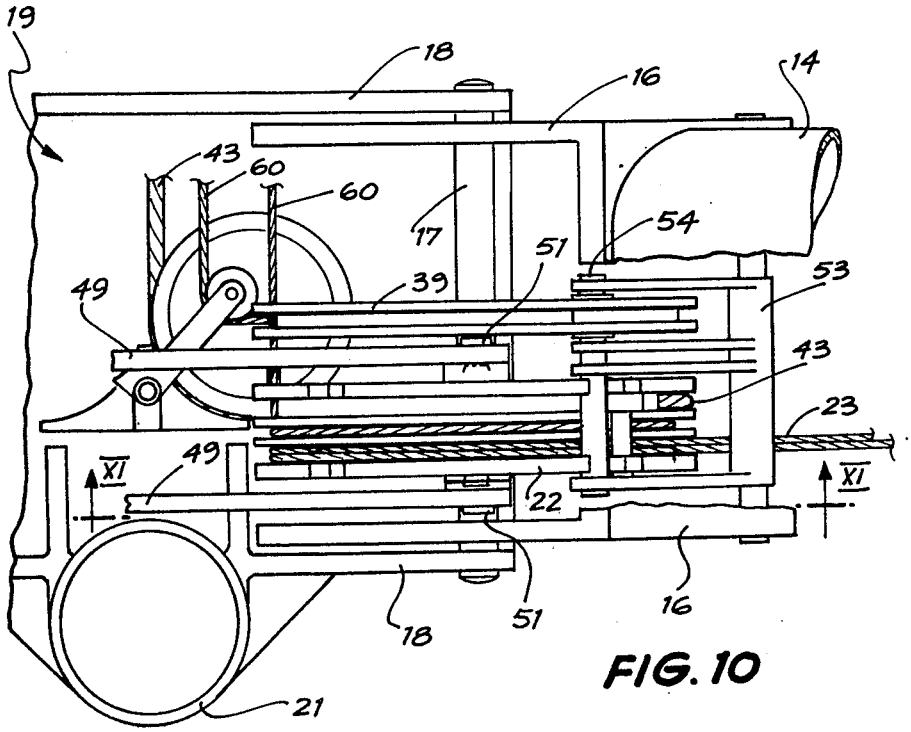
Figure 12:
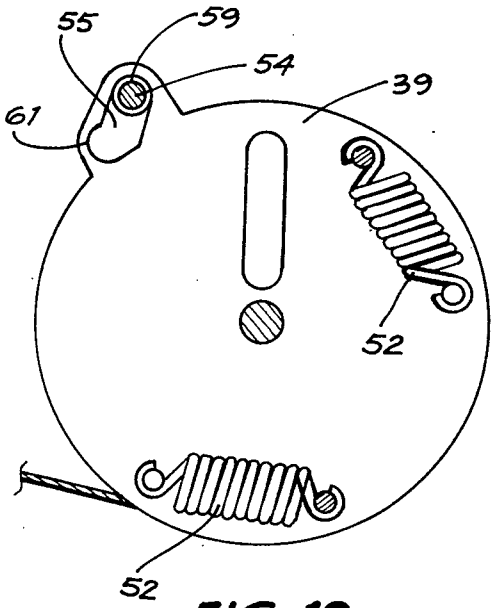
Figure 11:
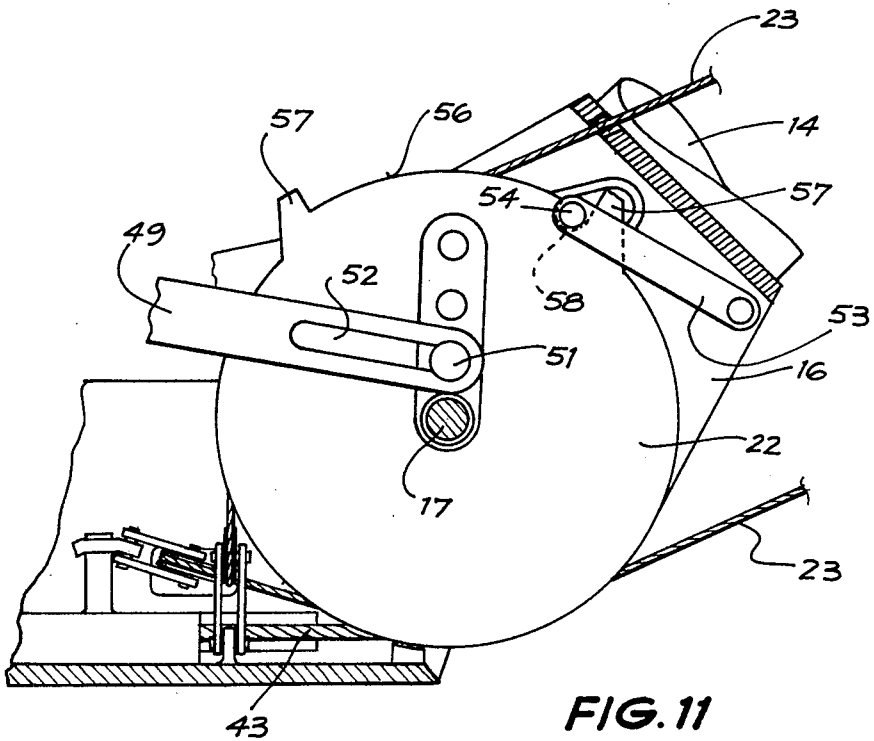
Figure 16:
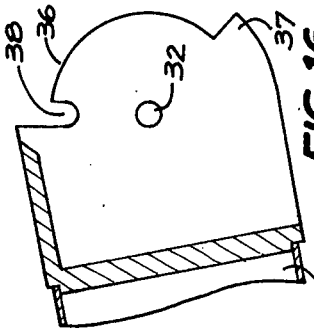
Figure 15:
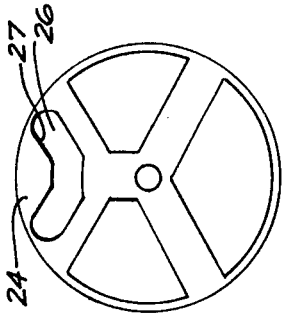
Figure 17:
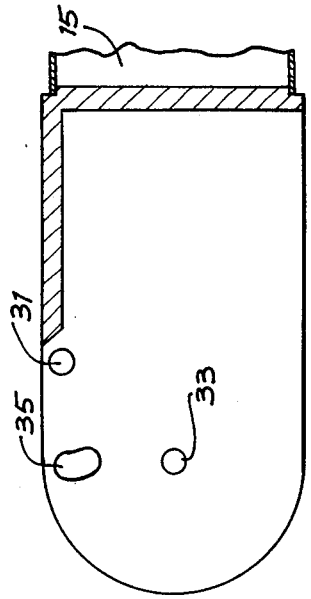
Figure 18:
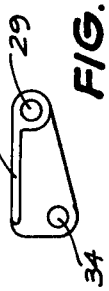
Figure 19:
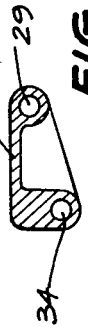
Figure 13:
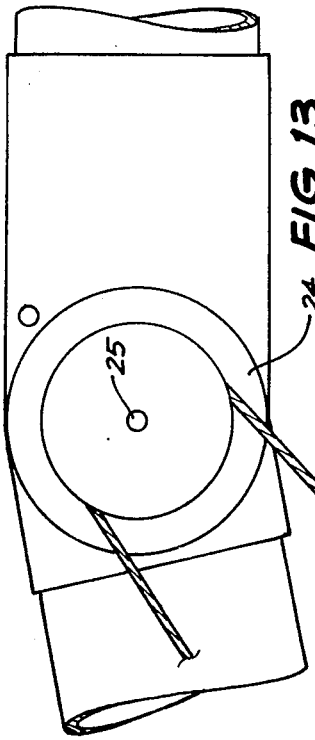
Figure 14:
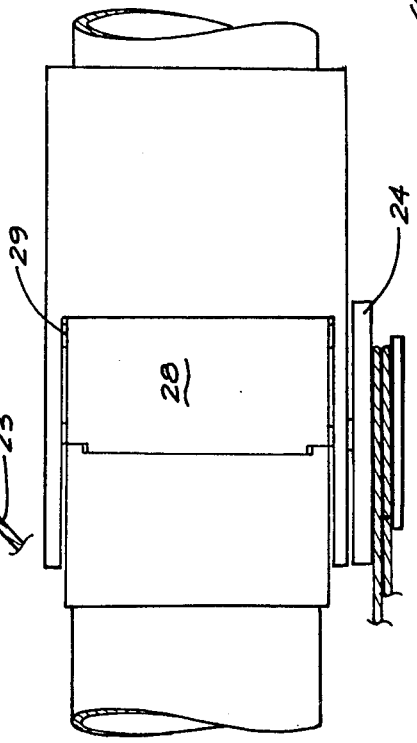
Figure 20:
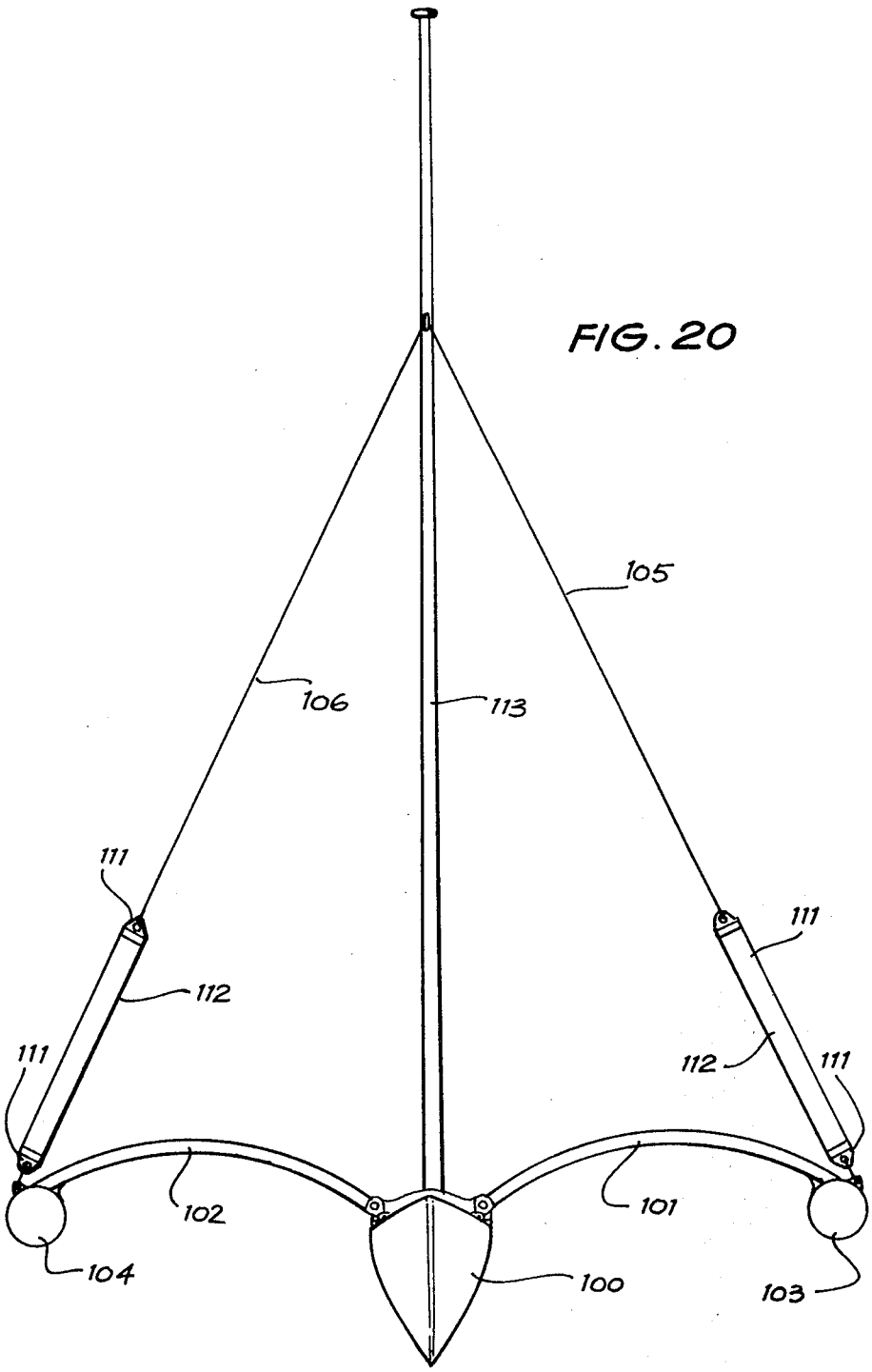
Figure 21:
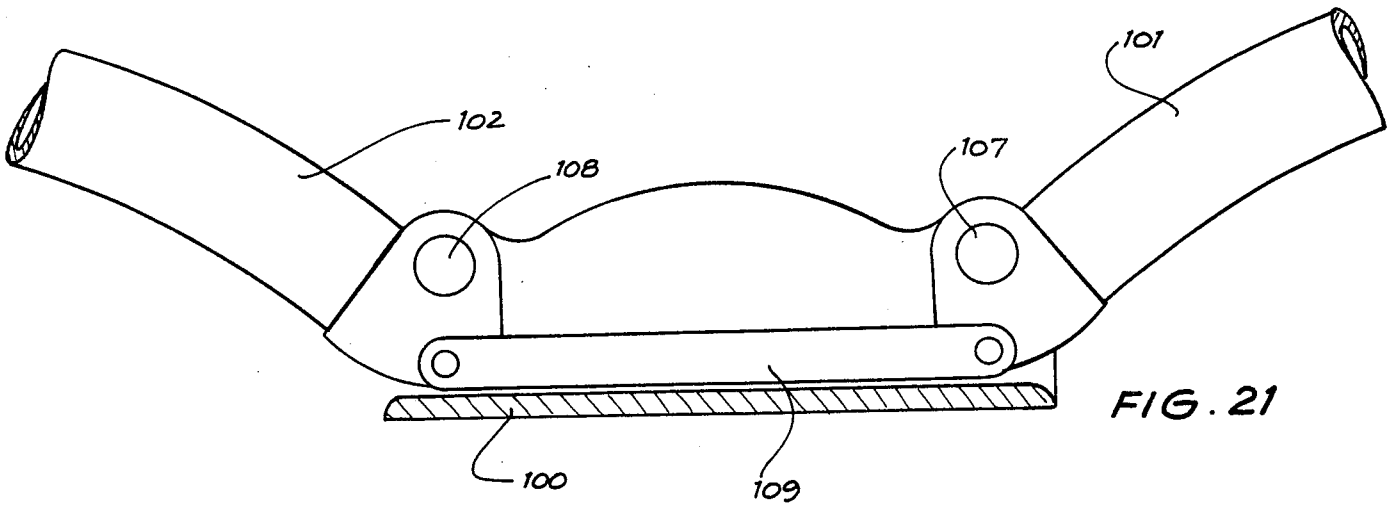
Figure 22:
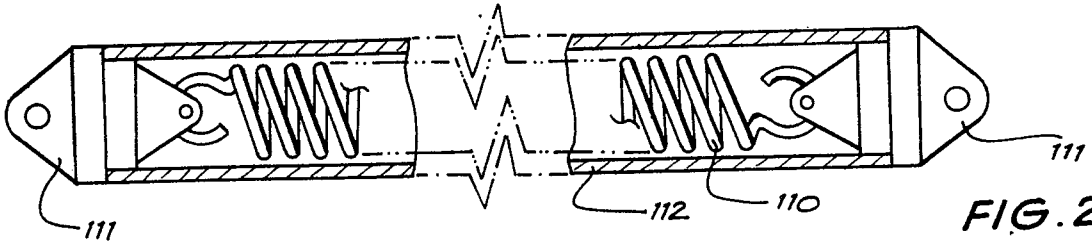

Hereinafter given by way of example only is a preferred embodiment of the present invention described with reference to the accompanying drawings in which:

FIG. 1 shows a front elevational view of a multi-hull vessel according to the present invention with the arms extended, FIG. 2 shows a front elevational view of the vessel of FIG. 1 with the arms in a retracted position, FIG. 3 shows a plan view of the vessel of FIG. 1, FIG. 4 shows a cross sectional view of the central hull cover of the vessel of FIG. 1 together with the spring means and other parts taken along IV—IV of FIG. 3, FIG. 5 shows a plan view of the central hull of the vessel of FIG. 1 with the central hull cover removed, FIG. 6 shows a fragmentary view of one end of the spring means, FIG. 7 shows a plan view of the winch used to extend the arms of the vessel of FIG. 1, FIG. 8 shows a side elevational view of the winch of FIG. 7, FIG. 9 shows a fragmentary side elevational view looking aft of the pivotal connection between a forward one of arms and the central hull, FIG. 10 shows a plan view of the pivotal connection of FIG. 9, FIG. 11 shows a sectional view along XI—XI of FIG. 10, FIG. 12 shows a side elevational view of the subsidiary sheave of the pivotal connection of FIG. 9, FIG. 13 shows a side elevational view looking aft of the pivotal connection between the inner and outer parts of one arm of the vessel of FIG. 1., FIG. 14 shows a plan view of the connection of FIG. 13, FIG. 15 shows a side elevational view of the sheave block of the connection of FIG. 13, FIG. 16 shows a longitudinal section through the outer end of the inner arm of the connection of FIG. 13, FIG. 17 shows a longitudinal section through the inner end of the outer arm of the connection of FIG. 13, FIG. 18 shows a side elevational view of a locking member forming part of the connection of FIG. 13, FIG. 19 shows a longitudinal section through the locking member of FIG. 18, FIG. 20 shows a front elevational view of a second embodiment of a sailing vessel according to this invention, FIG. 21 shows a front elevational view of the connection between the arms of the vessel of FIG. 21, and FIG. 22 shows a longitudinal sectional view of the spring means of the vessel of FIG. 21.

The vessel 10 is of the trimaran type having a central hull 11 and a pair of lateral hulls 12 joined to the central hull 11 by four arms 13.

The central hull 11 is hollow and has a longitudinally extending opening 41 in its upper side covered by a removable cover 42. Each of the arms 13 is connected, in a manner hereinafter described, to a sheave 22. A cable 43 is connected to the peripheral edge of each sheave 22. Each of the cable 43 terminates in a ferrule 44 slidably mounted in a bore in a transversely extending bar 45. The two ferrules 44 of the forward cables 43 are disposed in a forward bar 45 and the aft ferrules 44 in an aft bar 45. The port ends of bars 45 are connected by a coil spring 46 and the starboard ends of the bars 45 are likewise connected by spring 46. The ends of each of the ferrules 44 is provided with a head 47 such that the tension in the springs 46 is transmitted through the bars 45, the ferrules 44 and the cables 43 to the sheaves 22. The heads 47 of the ferrules 44 are each provided with an eye such that the port ferrules 44 can be connected by a shock-cord 48 and the starboard ferrules 44 similarly connected.

The forward pair of sheaves 22 are connected by a pair of link bars 49. Each link bar 49 is pivotably connected to one side of an associated sheave 22 by a stud 51. One of each pair of link bars 49 is so connected to each of the sheaves 22 that it can slide relative to its associated stud 5 by virtue of having an elongated aperture 52 formed adjacent its end.

The arrangement described above operates in the following manner. Each of the sheaves is biassed to rotate its associated arm 13 into an extended, horizontally extending position relative to the central hull 11. The downward movement of each sheave 22 and its associated arm 13 is prevented by the link arms 49 while upward movement is only possible against the action of the springs 46. If a force is applied to the central hull 11 through the sails and the mast, say from the port side, which exceeds the tension in the springs 46 then the starboard arms 13 will be caused to rotate upwardly (as seen in the drawings) relative to the central hull 11. This upward movement will cause the starboard sheaves 22 to rotate causing an elongation of the springs 46. The stretching of the springs 46 allows the arms 13 on the port side to fall, relative to the central hull 11, by an amount corresponding to the rise of the starboard arms 13. The slack in the port side cables 43 is taken up by the port side shock-cord 46 pulling the port side ferrules 44 through the bars 45.

Once the force applied to the sails is reduced the springs 46, acting through cables 43 will return the sheaves 22 to a position in which the spring tension applied to the two sheaves 22 is equal and the arms 13 are extending horizontally relative to the central hull 11.

The radial positioning of studs 51 in the sheave 22 can be used to control the amount of relative movement between the sheaves 22. The studs 51 on each sheave 22 are so disposed that the pivot point for one link bar 49 is radially inwardly of the pivot point for the link bar 49 on the other side of that sheave 22. This means that the windward sheave 22 will be allowed to rotate less, relative to the central hull 11 than the leeward sheave 22. The windward hull 12 will thus rise clear of the water as the central hull heels even though the position of the leeward hull relative to the water is not substantially changed.

Each arm 13 is formed of an inner part 14 and an outer part 15. Each outer part 15 is connected at its outer end to a corresponding one of the lateral hulls 12 and at its inner end is pivotally connected to the outer end of the inner part 14 of the arm 13. Each inner part 14 is in turn pivotally connected to the central hull 11 through a yoke 16.

Each yoke 16 is pivotally mounted on a pin 17 which is in turn supported between ears 18 of a casting 19, which includes a mast stepping tube 21, mounted on the central hull 11. Rotation of each inner arm part 14 about a pin 17 brings about unfolding of the arms 13 from a retracted to an extended position and is brought about in a manner described later in this specification. The connections between the central hull and the inner and outer parts 14 and 15 of each arm 13 is such that movement of the inner arm part 14 about the associated pin 17 causes a corresponding movement of the outer arm part 15. This is achieved in the following manner described with reference to only one of the four arms 13. A multi-grooved sheave 22 is provided on the pin 17 which sheave can for the purposes of this part of the description be regarded as being rigidly fixed to the pin as rotation of the sheave 22 is resisted by the tension in springs 46. An endless doubled cable 23 passes around one groove of the sheave 22 and around a sheave 24 mounted on one end of pin 25 which passes through hole 32 in the outer end of the inner part 14 and hole 33 in the inner end of the outer part 15 of the arm 13 and forms the axis of the pivotal connection between those parts. As the inner part 14 of arm 13 is rotated about the pin 17 and relative to sheave 22 the sheave 24 is rotated by cable 23. The inside surface of the sheave 24 is provided with a recess 26 which defines a camming surface 27. The inner end of the outer arm part 15 is pivotally connected to a latching flap 28 by pin 29 which extends laterally from flap 28 into apertures 31 in the inner end of the outer arm part 15. The end of latching flap 28 distal to pin 29 is provided with laterally extending pin 34 which extends through the elongate slot 35 in the inner end of the outer arm 15 and into recess 26 in the sheave 24. Rotation of sheave 24 by the cable 23 causes pin 34 and the latching flap 28 to be moved around the pin 25 drawing with them the outer arm part 15. As the pin 34 is moved by sheave 24 it is guided by a guiding surface 36 on the outer end of the inner arm part 14 between a stop 37, with which the pin 34 engages when the arm parts 14 and 15 are in their retracted configuration and a latching recess 38 into which the pin engages when the arm parts 14 and 15 are fully extended. The pin 34 is forced downwardly into the latching recess 38 by the action of the camming surface 27 of the recess 26 in the sheave 24. It can be seen that once the pin 34 is held in the latching recess 38 by the camming surface 27 forces applied to the outer arm part 15 will be transmitted to the inner arm part 14 through pivot pin 25 and through the latching flap 28 and its associated pins 29 and 34.

While the process of relative rotational movement between the inner and outer arm parts 14 and 15 is taking place corresponding relative rotational movement is taking place between the inner end of the inner arm 14 and the main hull 11. A single grooved subsidiary sheave 39 journalled on the pin 17 rotates relative to the sheave 22.

This relative movement tensions a pair of springs 52 disposed between adjacent surfaces of the sheaves 22 and 39. It also causes movement of a link 53 which is pivotably connected to the yoke 16 and has a pin 54 extending through an elongate aperture 55 in the periphery of the sheave 39. The pin 54 is guided by a camming surface 56 on the sheave 22 defined between a pair of spaced apart stop members 57. The camming surface 56 includes adjacent the stop member 57 which limits the outward extension of the arm 13 a locking recess 58.

As sheave 39 is rotated the pin 54 is caused to be moved and with it the link 53 and the inner arm part 14. When the pin 54, which is being guided by camming surface 56 reaches the locking recess 58 it will be forced into the recess by the sloping surface 59 of the aperture 55. Further movement of sheave 39 will cause surface 61 of aperture 55 to pass over pin 54 to retain it in the locking recess 58. The inner arm part 14 will thus be locked relative to sheave 22 and will move therewith.

The unlocking and retraction of the arm 13 is brought about by allowing sheave 39 to rotate in a direction opposite to that described above under the influence of springs 52.

The initial rotation of sheave 39 to cause extension and locking of the arm 13 is brought about by tensioning cables 60 which interconnect each set of sheaves 22 and 39. Each cable 60 passes around a pulley 61. The two forward pulleys 61 are connected to a forward yoke 62 while the aft pulleys 61 are connected to aft yoke 62. Cable 63 passes from an anchor point (not shown) in the keelplate of the central hull 11 around a further pulley 64 attached to the aft yoke 62, around a further pulley 64 attached to the forward yoke 62 and thence to a winch 65 mounted adjacent the mounting points for the aft pair of arms 13.

The winch 65 comprises a winch drum 66 to which the cable 63 is attached. Attached to the drum 66 is a cog wheel 67. The drum is rotated by movement of a winch arm 68 pivotably mounted to rotate about the axis of the drum 66. A ratchet mechanism 69 is provided on the handle 68 to allow the movement of the handle in an anti-clockwise direction, as seen in FIG. 8 of the drawings, to rotate the cog wheel 67 and drum 66 while allowing the handle 68 to be moved in the opposite direction without any accompanying movement of the cog wheel 67 or drum 66.

A pawl mechanism 69 is provided to control the release of the winch 65. The pawl mechanism comprises a shaft 71, pivotably connected to the keel boards of the central hull 11 by a bracket 72, and a latch 73 which engages with the teeth on cog wheel 67. A weight 74 is provided on the shaft 71 to which is attached a line 75.

In use, tensioning the cable 63 with the winch 65 will cause the yokes 62 to be drawn together. This movement of the yokes 62 causes the cables 60 running around pulley 61 to be tensioned. As the sheave 22 can be regarded for the present purposes as being fixed, tensioning of the cables 60 causes rotation of the sheaves 39 which, as has been described above, causes the arms 13 to extend. The winch 65 may be released by pulling the line 75 to raise the latch 73 or alternatively if the vessel were to become inverted the weight 74 would cause the latch to also drop (that is to move in an upward direction as seen in FIG. 8). In either case releasing the winch 65 allows the sheave 39 to rotate under the influence of the spring 52 thereby retracting the arm 13.

FIG. 20 shows a simpler version of a sailing vessel according to this invention. The central hull 100 is connected by two pairs of arms 101 and 102 to outrigger hulls 103 and 104 respectively. The hulls 103 and 104 are connected to the mast 113 by stays 105 and 106 respectively.

The arms of the pairs of arms 101 and 102 are each pivotally connected to the hull 100 by pins 107 and 108 respectively. The inner ends of the arms are linked together before the pins 107 and 108 by a bar 109 which is pivotally connected to each of the arms 101 and 102.

Each stay 105 and 106 includes a spring 110 connected at each end to a boss 111 and housed within a tubular housing 112. The spring 110 is maintained in a state of predetermined tension by the bosses 111 abutting the ends of the housing 112. One boss 111 of each spring is connected to one of the outrigger hulls 103, 104 and the outer boss of each spring is connected to a wire forming the remainder of the stay 105, 106.

In use if the wind on a sail connected to the mast 113 exceeds a velocity which imposes on the sail, and the mast 113, a force which in turn exceeds that necessary to elongate the windward spring 110 the mast 113, and the central hull 100 will heel relative to the windward outrigger hull.

The heeling of the mast 113 and the hull 100 will cause a pivotal movement of the windward arms (say 101) relative to the hull which pivotal movement will be transmitted into an equal but oppositely directed rotation of the leeward arms (say 102) by the bar 109.

I claim:

1. A sealing vessel comprising:

a pair of hulls, each hull having a longitudinal axis, said hulls substantially parallel to one another along their longitudinal axes;

a mast structure, intermediate said pair of hulls, each of said hulls connected to said mast structure by respective arm means which are each independently pivotably connected to respective sides of said mast structure such that each arm means can pivot about an axis substantially parallel to the longitudinal axes of said hulls;

and spring means, comprising at least one preloaded spring having a predetermined bias, connecting said mast structure and said arm means, and acting between said mast structure and said arm means such that pivotal movement of either of said arm means is only possible against the bias of said spring means, the arm means on a first side of said mast structure being linked by a linkage member to the arm means on the other side of said mast structure such that pivotal movement of the arm means on said first side of the mast structure will cause corresponding, but oppositely directed, pivotal movement of the arm means on said other side of said mast structure.

2. A sailing vessel as claimed in claim 1, wherein said mast structure comprises a mast and a mast supporting structure.

3. A sailing vessel as claimed in claim 2, wherein said mast supporting structure comprises a hull of the vessel which lies between and substantially parallel to said pair of parallel hulls.

4. A sailing vessel as claimed in claim 1, wherein said arm means comprise at least two opposed pairs of arms, one arm of each opposed pair of arms disposed on one side of said mast structure and the other arm of said opposed pair of arms disposed on the other side of said mast structure.

5. A sailing vessel as claimed in claim 4, wherein said spring means comprises a plurality of helical tension springs connected at each end to at least one pair of cables, each of said at least one pair of cables corresponding to an opposed pair of arms, each of said cables respectively pass around suitable pulleys and connectingly terminate on the outer periphery of a sheave affixed to a respective arm of said opposed pair of arms, said sheave being coaxial with the pivotal axis of said arm.

6. A sailing vessel as claimed in claim 4, wherein each of said arms is formed in two parts comprising an inner arm part and an outer arm part which are pivotably joined together intermediate the mast structure and a respective hull of said pair of parallel hulls.

7. A sailing vessel as claimed in claim 6, wherein said outer arm part is pivotable with respect to said inner arm part about an axis parallel to the longitudinal axes of said pair of parallel hulls.

8. A sailing vessel as claimed in claim 7, wherein said spring means detachably connects said mast structure and said arm means, and wherein said inner and outer arm parts are so interlinked that rotation of the inner part with respect to the mast structure, when the arm is detached from said spring means, causes a corresponding rotation of the outer arm part.

9. A sailing vessel as claimed in claim 8, wherein release means are provided to automatically cause the detachment of said spring means from said arm upon the capsize of the vessel.

10. A sailing vessel as claimed in claim 1, wherein said spring means comprises one or more helical tension springs.

* * * * *